US008119939B2

(12) United States Patent
Albrecht et al.

(10) Patent No.: US 8,119,939 B2
(45) Date of Patent: Feb. 21, 2012

(54) ON-LOAD TAP CHANGER WITH AN ENERGY STORAGE MECHANISM

(75) Inventors: Wolfgang Albrecht, Wenzenbach (DE); Thomas M. Huber, Maxhuette-Haidhof (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 807 days.

(21) Appl. No.: 12/280,569

(22) PCT Filed: Nov. 4, 2006

(86) PCT No.: PCT/EP2006/010580

§ 371 (c)(1),
(2), (4) Date: Aug. 25, 2008

(87) PCT Pub. No.: WO2007/095978

PCT Pub. Date: Aug. 30, 2007

(65) Prior Publication Data

US 2009/0000927 A1 Jan. 1, 2009

(30) Foreign Application Priority Data

Feb. 23, 2006 (DE) ..... 10 2006 008 338

(51) Int. Cl.
*H01H 19/00* (2006.01)
*H01H 21/00* (2006.01)

(52) U.S. Cl. ..... 200/11 TC

(58) Field of Classification Search ..... 200/11 TC, 200/400; 74/111, 112, 116, 126, 128, 141
See application file for complete search history.

(56) References Cited

U.S. PATENT DOCUMENTS

| | | | | |
|---|---|---|---|---|
| 6,838,629 | B2 * | 1/2005 | Baertl | 200/501 |
| 7,518,075 | B2 * | 4/2009 | Wrede et al. | 200/400 |
| 7,652,218 | B2 * | 1/2010 | Hoepfl et al. | 200/400 |

FOREIGN PATENT DOCUMENTS

| | | |
|---|---|---|
| DE | 1515946 | 3/1970 |
| DE | 2518599 | 9/1976 |
| DE | 2719396 | 10/1978 |
| DE | EP-0355814 | 2/1990 |
| DE | 10315206 | 10/2004 |

OTHER PUBLICATIONS

"Vacuum-switching, a well proven technology . . . " D. Dohnal, IEEE 2001 0-7803-7285-9/01.

"On-Load Tap Changer VACUTAP® VV Operating Instructions" MR Reinhausen.

* cited by examiner

*Primary Examiner* — Renee Luebke
*Assistant Examiner* — Lheiren Mae Caroc
(74) *Attorney, Agent, or Firm* — Andrew Wilford

(57) ABSTRACT

The invention relates to an on-load tap changer having an energy storage mechanism for changing over, without any interruptions, between different winding taps of a tap-changing transformer on load. According to the invention, the energy storage mechanism has one or more compression springs, which are tensioned at the beginning of a changeover operation. In comparison with the tensile springs used to date with such energy storage mechanisms, the compression springs have markedly greater long-term strength.

4 Claims, 2 Drawing Sheets

ON-LOAD TAP CHANGER WITH AN ENERGY STORAGE MECHANISM

CROSS REFERENCE TO RELATED APPLICATIONS

This application is the US national stage of PCT application PCT/EP2006/010580, filed 4 Nov. 2006, published 30 Aug. 2007 as WO 2007/095978, and claiming the priority of German patent application 102006008338.5 itself filed 23 Feb. 2006, whose entire disclosures are herewith incorporated by reference.

FIELD OF THE INVENTION

The invention relates to an on-load tap changer having a force-storing unit for the uninterrupted switching between different winding taps of a tapped transformer under load.

BACKGROUND OF THE INVENTION

An on-load tap changer of this type along with an associated force-storing unit is known from publication of the applicant "On-load tap Changer VACUTAP® VV Operating Instructions," imprint BA164/03de. This on-load tap changer combines the function of a selector for the no-load preselection of the tap to which the changeover is to be made, as well as a load transfer switch for the actual switching.

The force-storing unit of this known on-load tap changer has a flexible sheet-metal plate on which several tension springs are attached at one end, the springs being pivoted at their other ends on bearings. The free end of the flexible sheet-metal plate in turn is rotatably mounted on a drive crank. The drive crank that is mounted on an operating shaft is actuated through a one-way clutch means by a drive element that is coaxial with and rotatable on and independently of this shaft. At its bottom end the operating shaft supports a Geneva crank of a Geneva drive. Finally, the Geneva wheel of this Geneva drive is connected to a rotatable switching column supported coaxially inside an insulating tube, this column supporting the switching elements on a radially projecting arm.

Fixed tap contacts are provided in the wall of the insulating tube at vertically spaced horizontal planes, these contacts being selectably connectable in each plane to one of the switching elements on the switching column.

The functional principle of this known force-storing unit is as follows:

At the start of a load-switching operation, i.e. switching from one winding tap to an adjacent different winding tap, the drive element, actuated generally by a drive motor, begins to turn slowly and continuously. The drive element entrains the drive crank via an abutment, and with it also the end of the flexible sheet-metal plate attached thereto, thereby moving and tensioning the tension springs. After an initial rotation angle of 180° when the tension springs have reached their maximum displacement, the drive element disengages from the drive crank due to the one-way clutch. After passing dead center, the next rotation of the drive crank occurs by snap action since the tension springs are still tensioned at this point in time.

This rapid rotational motion of the drive crank is transferred to the Geneva crank of the Geneva drive, and thus to the switching column; the switching elements attached thereto switch by snap action to each of the adjacent fixed tapping contacts. The tap changing operation has concluded.

This force-storing unit has proven successful over many years for the widest variety of load tap changers. Nevertheless, the tension springs used do not have unlimited mechanical fatigue strength but must be replaced after a predetermined operating life or permissible number of operations for reason of safety. This has not been a problem up to now since generally inspections are performed on the on-load tap changer in any case after this permissible number of operations. Due to the high reliability of the vacuum-type switching cells now available and used, and the overall advantages of vacuum switching technology, it is now possible, however, to increase the maintenance intervals for on-load tap changers such that the limited mechanical fatigue strength of the employed tension springs has increasingly proven to be a disadvantage for the known force-storing units.

OBJECT OF THE INVENTION

The object of the invention is therefore to provide an on-load tap changer of the generic kind with a force-storing unit that has energy storage springs as the force-storing unit, this mechanism having a higher mechanical fatigue strength.

SUMMARY OF THE INVENTION

The problem is solved by an on-load tap changer with a force-storing unit in which the force-storing unit is a compression spring supported on one end against a fixed spring abutment, a pull rod (10) is mounted on the drive crank, and at least one movable spring abutment is provided on the pull rod, another end of the compression spring being supported on the fixed spring abutment.

In addition to the intended almost unlimited mechanical fatigue strength of the compression springs employed, the breakage of which is practically impossible, the advantage of the invention lies in the fact that the amount of force of the force-storing unit can be continuously adjusted due to the use of a threaded adjustable pull rod. As a result, it easily becomes possible to adjust the force-storing unit in advance to a wide variety of types of load tap changers and to adjust the force-storing unit in terms of the force released after triggering. The force-storing unit according to the invention is usable with a wide variety of on-load tap changers; it can be used both with equipment switching under oil using mechanical tap contacts and also with those having vacuum switching cells.

BRIEF DESCRIPTION OF THE DRAWING

The following discussion explains the invention in more detail based on the drawings. In the drawings.

DETAILED DESCRIPTION

Figure 1:
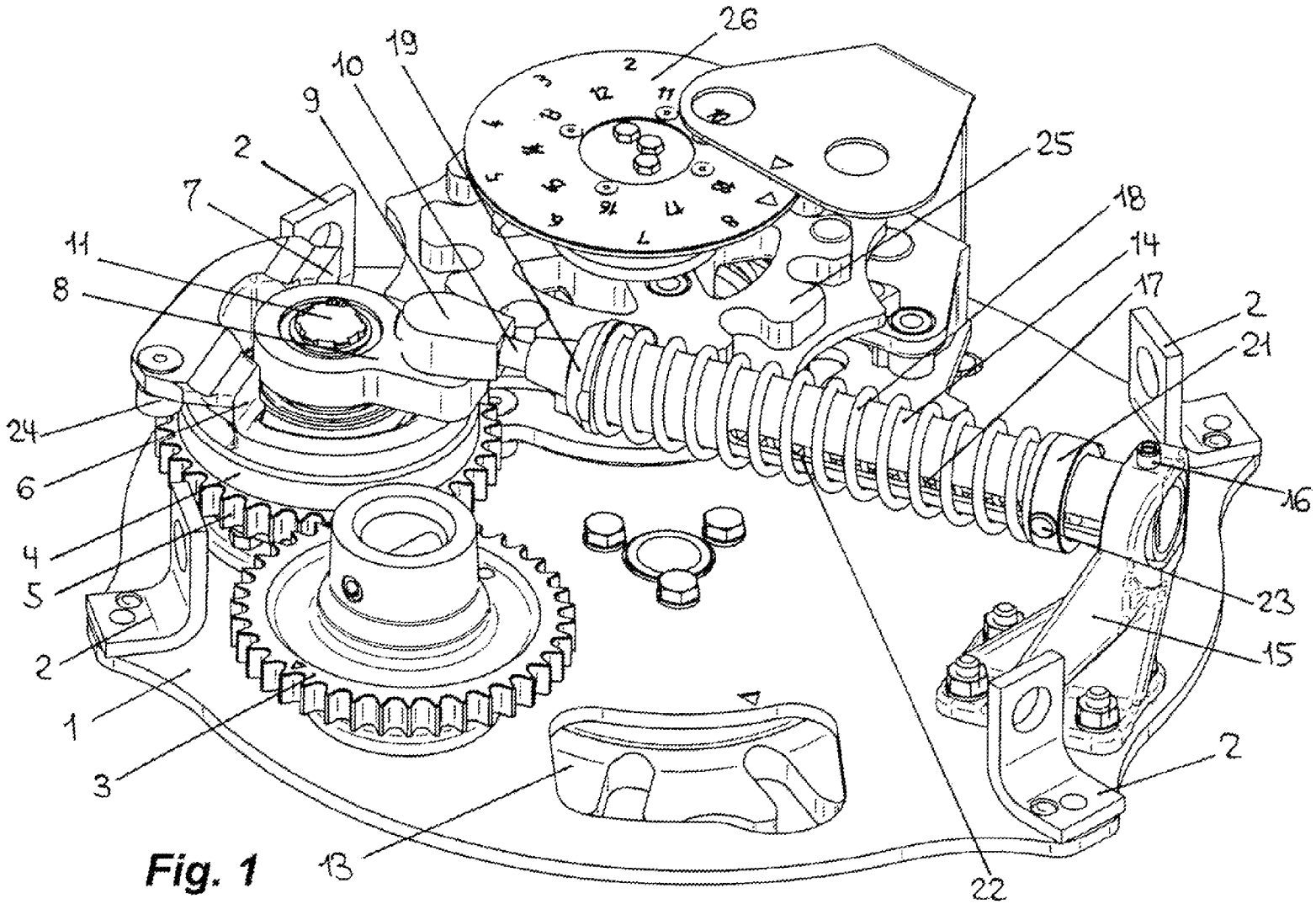
FIG. 1 is a perspective view illustrating the top portion of an on-load tap changer according to the invention with a force-storing unit.

FIG. 1 will be described in detail first. Shown is a base plate 1 on which the entire force-storing unit and drive arrangement for actuating the on-load tap changer is mounted and which in turn is mounted normally at an upper end of a dielectric cylinder 29 (FIG. 2 only) carrying a multiplicity of contacts 30 of which only one is shown. The base plate 1 has support brackets 2. A gear wheel 3 is shown that is connected to an unillustrated drive-motor shaft. The gear wheel 3 drives a drive element 4 by means of its gear teeth 5. The drive element 4 in turn has two symmetrical catches 6 and 7 that coact with a drive crank 8. This will be explained in more detail later. A head 9 of a pull rod 10 is pivoted on the drive crank 8. The pull rod 10 is connected to additional parts of the force-storing unit according to the invention that will be explained in detail further below. The drive crank 8 is attached to an operating shaft 11 that passes vertically downward completely through the base plate, the lower end of the shaft having a Geneva crank shown in FIG. 2 at reference 12. This Geneva crank 12 extends into a Geneva wheel 13 that in turn is connected to a schematically illustrated switching column 31 carrying an arm 32 having an outer end forming a contact 33 engageable with one the contacts 30.

A spring tube 14 is provided according to the invention surrounding the described pull rod 10. One end of the spring tube 14 is linked to a bearing block 15; it is horizontally pivotal by means of a vertical pivot pin 16. An inner compression spring 17 is provided between the pull rod 10 and the spring tube 14; an outer compression spring 18 is mounted concentrically outside the spring tube 14. In the embodiment illustrated here, an arrangement comprising the inner compression spring 17 and the outer compression spring 18 was selected to generate strong forces. Within the scope of the invention, however, it is also possible to provide only a single compression spring, optionally either inside or outside the spring tube 14. It is also possible to provide more than two compression springs. In the embodiment of the invention illustrated in FIG. 1, the inner compression spring 17 and the outer compression spring 18 are each braced at one end against a fixed spring abutment 19 that is connected to the spring tube 14. At the other end, the inner compression spring 17 is braced against a movable inner spring abutment 20, shown only in FIG. 2, while the outer compression spring 18 is braced against a movable outer spring abutment 21 forming with the inner abutment 20 a common spring abutment. The inner and outer spring abutments 20 and 21 are connected to the free end of the pull rod 10. The inner spring abutment 20 here is attached directly to the pull rod 10. To attach the outer spring abutment 21 surrounding the spring tube 14 to the pull rod 10, longitudinal slots 22 are provided on both sides in the spring tube 14. A support pin or mounting bolt 23 projects outward through these longitudinal slots 22 and attaches the pull rod 10 and the outer spring abutment 21 to each other. Also illustrated in FIG. 1 is a roller 24 that cooperates with another Geneva wheel 25 that in the known manner actuates a position indicator 26, and also in the known manner actuates a preselector.

The arrangement according to the invention as illustrated in FIG. 1 functions as follows:

In order to initiate a switchover operation, i.e., each actuation of the on-load tap changer, a drive motor rotates the gear wheel 3 by the unillustrated drive-motor shaft. This rotation is transmitted through the gear teeth 5 to the drive element 4. Depending on the direction of rotation, which depends on whether the next load transfer is to occur in the direction "higher" or "lower," one of the two catches 6 or 7 of the drive element 4 positively engages the drive crank 8 and simultaneously rotates this crank 8. At the same time, the pull rod 9 attached to the drive crank 8 is moved simultaneously; the pull rod 10 is displaced and the compression springs 17 and 18 are compressed. After the drive crank 8 rotates 180°, the pull rod 10 has reached its new end position; the compression springs 17 and 18 are under maximum compression. After passing through dead center, the previously positively engaged catch 6 or 7 is disengaged and rotation of drive crank 8, and thus of operating shaft 11, is quickly terminated since the compression springs 17 and 18 are released by snap action. This rapid rotational motion is transmitted through the Geneva crank 12 and the Geneva wheel 13 to the switching column, not shown, of the on-load tap changer. Fast switching is effected between adjacent fixed tapping contacts within the dielectric cylinder.

Figure 2:
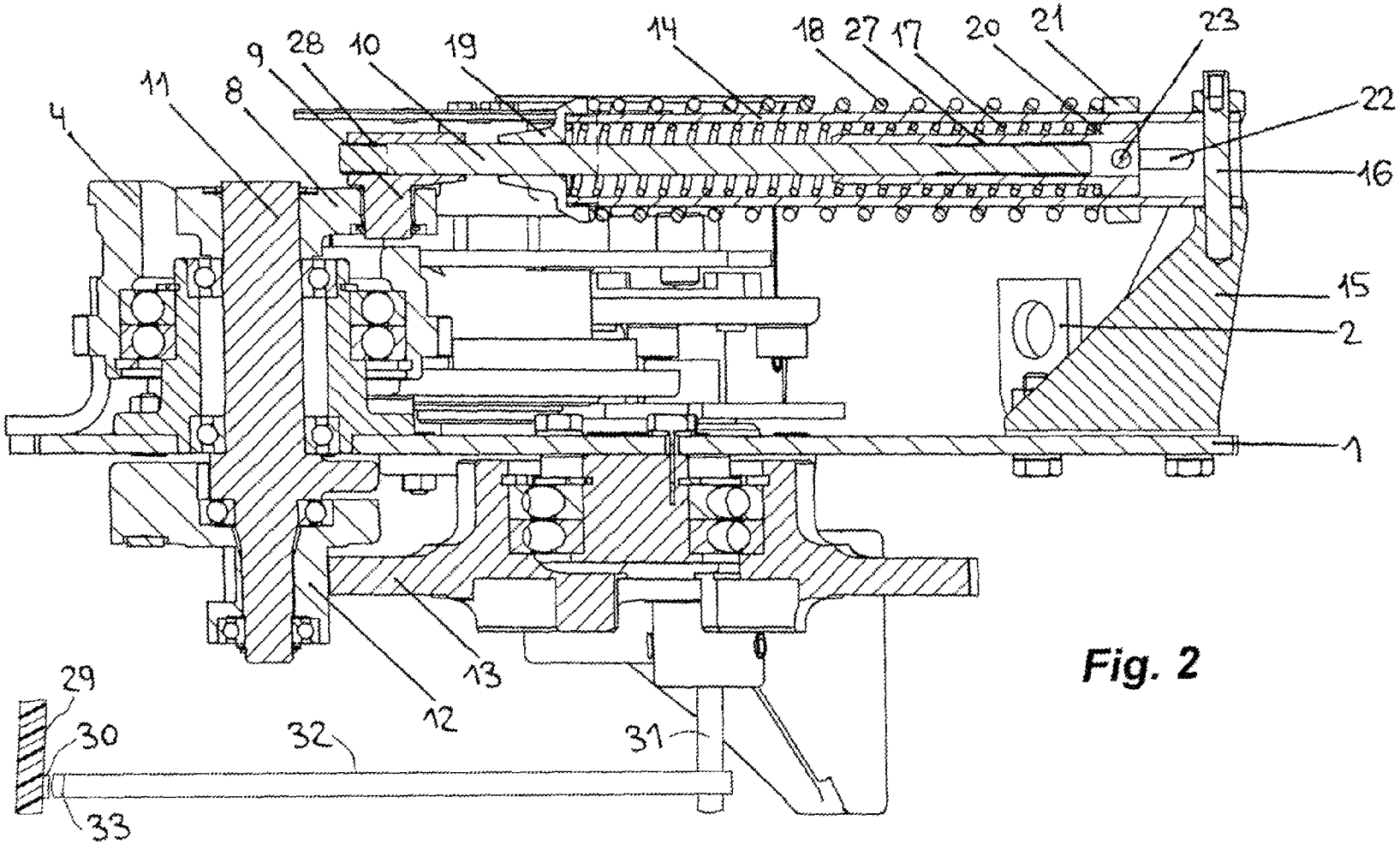
FIG. 2 is a schematic sectional side view of such an on-load tap changer with a force-storing unit.

FIG. 2 illustrates a sectional side view of the described arrangement according to the invention. For the sake of completeness, those other components known from the art are not described in detail here.

What is evident here is that, in an especially advantageous development of the invention, one end of the pull rod 10 is secured by a screwthread 27 into the inner abutment 20. Due to this thread 27, especially advantageously in the form of a fine-pitch thread, what results is an adjustable pull rod 10 in which the effective length between fixed spring abutment 19 and movable spring abutments 20 and 21 can be easily modified. As a result, the spring lengths of the compression springs 17 and 18, and thus the effective spring loads, can be continuously and easily adjusted. In this embodiment, the force-storing unit can be readily adapted to the specific requirements in terms of the energy of the released energy storage springs, which energy can vary as a function of the switch type and switching sequence.

It would also be possible within the scope of the invention to implement the adjustment capabilities of pull rod 10 by means of an additional thread 28 on the pull rod head 9.

The invention claimed is:

1. An on-load tap changer with an energy storage mechanism for uninterrupted changing over between different winding taps of a tapped transformer under load, the on-load tap changer comprising:

a tubular dielectric cylinder having a wall and centered on an axis;

fixed tap contacts in the wall;

an axially extending switch column in the cylinder;

drive means including a drive crank on the column for rotating the column;

at least one switching element on the column engageable with the tap contacts;

a support plate fixed in the cylinder;

a spring tube pivoted on the support plate;

a rod extending from the crank coaxially in the tube;

a common spring abutment carried on the spring tube;

an inner energy-storing compression spring between the rod and the tube, having one end bearing on the common spring abutment, and extending away from the crank;

an outer energy-storing compression spring coaxially surrounding the tube, having one end bearing on the common spring abutment, and also extending away from the crank;

a movable spring abutment on the rod against which another end of the inner spring bears; and a support pin projecting radially outward through the tube from the movable spring abutment and against which another end of the outer spring bears.

2. The on-load tap changer defined in claim 1 wherein the tube is formed with longitudinally elongated slots through which the support pin extends.

3. The on-load tap changer defined in claim 1 wherein the movable abutment and the rod are formed with interengaging screw threads and the movable abutment can be screwed along the rod to change prestress in the springs.

4. The on-load tap changer defined in claim 1 further comprising a pivot carrying an outer end of the rod outside the tube.

* * * * *